US007076841B2

(12) United States Patent
Möller et al.

(10) Patent No.: US 7,076,841 B2
(45) Date of Patent: Jul. 18, 2006

(54) DOUBLE PRESSURE CYLINDER ARRANGEMENT AND LOADING DEVICE OF A TEXTILE MACHINE HAVING SUCH DOUBLE PRESSURE CYLINDER ARRANGEMENT

(75) Inventors: Rudolf Möller, Gehrden (DE); Dirk Kröger, Laatzen (DE); Salih Agca, Hannover (DE)

(73) Assignee: Rexroth Mecman GmbH, Hannover (DE)

( * ) Notice: Subject to any disclaimer, the term of this patent is extended or adjusted under 35 U.S.C. 154(b) by 0 days.

(21) Appl. No.: 10/813,069

(22) Filed: Mar. 31, 2004

(65) Prior Publication Data

US 2004/0187269 A1 Sep. 30, 2004

(30) Foreign Application Priority Data

Mar. 31, 2003 (DE) ..... 103 14 428

(51) Int. Cl.
*D01H 5/46* (2006.01)

(52) U.S. Cl. ..... 19/266

(58) Field of Classification Search ..... 19/236, 19/258, 260, 261, 266, 267, 271, 272, 273, 19/278, 290–295
See application file for complete search history.

(56) References Cited

U.S. PATENT DOCUMENTS

| | | | | |
|---|---|---|---|---|
| 4,890,359 A | | 1/1990 | Kagi et al. | |
| 5,953,793 A | * | 9/1999 | Roder | 19/266 |
| 6,134,752 A | * | 10/2000 | Gohler et al. | 19/272 |
| 6,154,931 A | * | 12/2000 | Corrales | 19/267 |

FOREIGN PATENT DOCUMENTS

DE 42 09 392 A1 9/1993

* cited by examiner

*Primary Examiner*—Gary L. Welch
(74) *Attorney, Agent, or Firm*—Venable LLP; Robert Kinberg; Steven J. Schwarz

(57) ABSTRACT

A double pressure cylinder arrangement including a first pressure cylinder and a second pressure cylinder positioned in a spaced and axis-parallel relationship to the first pressure cylinder. A carrier strut is connected to a bottom side of the first pressure cylinder and the second pressure cylinder. The carrier strut includes a intermediate section. A substantially u-shaped housing element has two leg sections. Each leg section houses one of the pressure cylinders. Connection lines for driving the first pressure cylinder and the second pressure cylinder are integrated in the intermediate section.

19 Claims, 2 Drawing Sheets

DOUBLE PRESSURE CYLINDER ARRANGEMENT AND LOADING DEVICE OF A TEXTILE MACHINE HAVING SUCH DOUBLE PRESSURE CYLINDER ARRANGEMENT

CROSS-REFERENCE TO RELATED APPLICATION

This application claims the priority of German Patent Application No. 103 14 428.5 filed Mar. 31, 2003, the disclosure of which is incorporated herein by reference.

FIELD OF THE INVENTION

The present invention relates to a double pressure cylinder arrangement. Preferred embodiments of the present invention include a first pressure cylinder positioned in a spaced and axis-parallel relationship to a second pressure cylinder by means of a carrier strut, wherein the carrier strut is connected with both pressure cylinders at the bottom sides thereof. The present invention also relates to a loading device for a drafting arrangement of a textile machine, wherein preferred embodiments include such a double pressure cylinder arrangement.

BACKGROUND OF THE INVENTION

A double pressure cylinder arrangement of the kind referred to is preferably used in the textile machine industry. In a drafting arrangement for fiber material, the double pressure cylinder arrangement is used in a loading device. A drafting arrangement essentially includes a series-connected arrangement of a plurality of top and bottom roller pairs, wherein each top roller may have a force applied to it by means of the double pressure cylinder arrangement in order to press it against the bottom roller. Accordingly, the support of the top roller is usually of the floating type. Fiber material is continuously passed between each top and bottom roller pair and generally drafted by a series connection of a plurality of such drafting arrangements so that the fiber material is subjected to a lasting extension. For this purpose, the individual drafting arrangements have different speeds.

In EP 0 939 151 A2 a drafting arrangement of the above kind is disclosed having a loading device equipped with corresponding double pressure cylinder arrangements. The loading device essentially includes a loading arm for supporting the top rollers of the drafting arrangement. The three top rollers are adjacent to associated bottom rollers. The top rollers are rotatably supported at both ends in corresponding bearings and are pressed against the bottom roller by the loading device in order to create a permanent frictional engagement with the passing fiber material, so the latter can be extended when it passes through the drafting arrangement. The spaces between the top rollers are made to be adjustable because different spaces are required depending on the fiber material to be stretched. The pressure force on the top rollers generated by the loading device is controlled by a pressure of pressurized air applied to the loading device via suitable pressure lines. The loading arm is also pivotable about a pivot point, so that the loading arm may be opened to make the drafting arrangement accessible in the area between the top and bottom rollers when new fiber material is inserted or malfunctions are removed.

Pressurized air may be applied to the double pressure cylinder arrangement of the loading device at the side facing away from the piston so that the pressure force generated in this way is transferred to the two end areas of each top roller via the two piston rods having parallel axes. Each top roller has a separate double pressure cylinder arrangement associated with it.

The prior art double pressure cylinder arrangement is made of two identical standard cylinders attached to a carrier strut at their cylinder bottoms by means of bolts in order to generate the desired parallel, spaced pressure force for the associated top roller. The carrier strut is a bent sheet metal part which is very costly to manufacture. Moreover, the standard cylinders available for the usage referred to have a long structural length, so that the entire double pressure cylinder arrangement extends from the drafting arrangement in an interfering manner. Due to this bulky structure, the pivotable loading arm is also difficult to handle. Additionally, because of the exposed electrical and pneumatic connection lines at the standard cylinders, there is a risk of the lines getting ripped off. The individual parts of the prior art double pressure cylinder arrangements are also difficult to assemble.

SUMMARY OF THE INVENTION

It is therefore an object of preferred embodiments of the present invention to create a double pressure cylinder arrangement, which unlike the state of the art described above is designed in a user-friendly way and which works reliably using only a few individual structural components.

Departing from a double pressure cylinder arrangement, the above object is achieved according to preferred embodiments of the present invention, which include a double pressure cylinder arrangement that includes a first pressure cylinder and a second pressure cylinder positioned in a spaced and axis-parallel relationship to the first pressure cylinder. A carrier strut is connected to a bottom side of the first pressure cylinder and the second pressure cylinder. The carrier strut includes an intermediate section. A substantially u-shaped housing element has two leg sections. Each leg section houses one of the pressure cylinders. Connection lines operative in driving the first pressure cylinder and the second pressure cylinder are integrated in the intermediate section. The present invention also includes a loading device for a drafting arrangement of a textile machine.

Preferred embodiments of the present invention may also incorporate the technical background that for a double pressure cylinder arrangement, an essentially u-shaped housing element with two leg sections is provided, each forming a cylinder housing for the pressure cylinders, wherein various connection lines for driving the two pressure cylinders may be accommodated in a hollow intermediate section forming the carrier strut.

The advantage of the approach according to preferred embodiments of the present invention is in particular that due to a functional integration of various housing components the number of individual components is minimal. The individual carrier strut which is costly to manufacture may be wholly eliminated. By departing from the well-known design using standard cylinders, the overall structural size of the double pressure cylinders arrangement may be minimized. By accommodating the connection lines in the intermediate section forming the carrier strut, the risk of any lines getting ripped off is reliably avoided. The functionally integrated approach according to the invention requires fewer sealable surfaces interfacing with other components, which over the lifetime of the machine may be the cause of malfunctions. This ensures more reliable operation over the lifetime in comparison to the prior art double pressure cylinder arrangements.

The double pressure cylinder arrangement may also have means for releasably locking on a carrier structure, such as a loading device of a drafting arrangement, which at least in the area of the one of the leg sections of the housing element is integrated adjacent to the pressure cylinder. When used in combination with a loading device for a drafting arrangement, a pivoting movement, which has a pivoting axis in the area of the opposing leg section, may thus be achieved, while releasable locking in the operational position is ensured. This may be achieved in structural terms, for example, by means of a spring loaded push-button integrated in the area of the leg section.

Preferably, connection means for fluid and/or electrical supply of the two pressure cylinders are provided, which are integrated at least in the area of one of the leg sections of the housing element adjacent to the pressure cylinder. In the case of the use of the double pressure cylinder arrangement with a loading device for a drafting arrangement, the integration may be suitably within that leg section which is in the area of the pivoting bearing. The connection means exit the housing element preferably at the bottom surface of the leg section. Further extensions of pressure medium lines for driving the two pressure cylinders and/or electrical lines for connection with sensor elements or the like are easily connected. In case the connection means are provided in combination with means for releasably locking the double pressure cylinder arrangement, the connection means for fluid and/or electrical supply of the pressure cylinders and means for releasably locking on a carrier structure are each suitably exclusively associated with one leg section of the housing element. This achieves a space-saving and uniform arrangement of the components within the unshaped housing element.

A particularly space-saving arrangement is achieved if on the one hand the connection means for fluid and/or electrical supply of the pressure cylinders and on the other hand the means for releasably locking on a carrier construction are each accommodated in an area of the leg sections positioned toward the outside adjacent to each inside pressure cylinder. This does not contribute to the overall structural height so that the integration of these additional components does not affect the compactness of the double pressure cylinder arrangement.

According to a further measure for improving the invention, the connection lines integrated in the intermediate section of the housing element may include on the one hand integrated connection lines for driving the two pressure cylinders and on the other hand electrical signal lines for position sensors associated with each pressure cylinder and accommodated side by side in the intermediate section of the housing element, therefore forming a kind of cable duct. It is also conceivable for at least the pressure medium lines to be integrated as corresponding channels in the intermediate section of the housing element. In case of separately installed connection lines, these are advantageously accessible via a cover extending along the top of the intermediate section and releasably attached on the housing element via clip fasteners. These clip fasteners may be secured using additional securing members, such as bolts or the like. All connection lines may therefore be easily accessible via the releasable cover for assembly or repair purposes.

The housing element together with the cover may be particularly advantageously manufactured of plastic material by injection molding. It has been shown that the housing element can be manufactured of plastic material when it is statically optimized, which ensures simple manufacture.

According to a further measure for improving the present invention, each pressure cylinder may be closed by a cylinder cover through which the piston rod extends, wherein the gap between the cylinder cover and the housing element is used for inserting a bolt in order to reliably hold the cylinder cover on the housing element. In particular, when the double pressure cylinder arrangement of the present invention is used together with a loading device for a drafting arrangement, this simple approach is suitable since the pressure cylinders are only of the single-acting type, so that sealing problems do not occur in the area of the cylinder cover. The single-acting pressure cylinders may have pressurized air as a pressure medium applied to them for essentially simultaneously extending the piston rods.

When the double pressure cylinder arrangement of the present invention is used with a loading device for a drafting arrangement, a gas-pressurized spring damping the pivoting movement may also be mounted on the u-shaped housing element and may act as a rebound safety feature against an unintentional backward swing of the loading arm. In this case the gas-pressurized spring is mounted between the double pressure cylinder arrangement on the one hand and the carrier construction on the other hand.

A plurality of recesses or the like may also be provided on the intermediate section of the double pressure cylinder arrangement and used for clip fastening a vacuum sheet of the drafting arrangement. Bolting elements, which are mounted at relatively high cost, may be eliminated in this place.

BRIEF DESCRIPTION OF THE DRAWINGS

Further measures for improving the invention are illustrated in more detail in the following together with the description of the preferred exemplary embodiment of the present invention with reference to the accompanying drawings, in which.

DETAILED DESCRIPTION OF THE INVENTION

Figure 1:
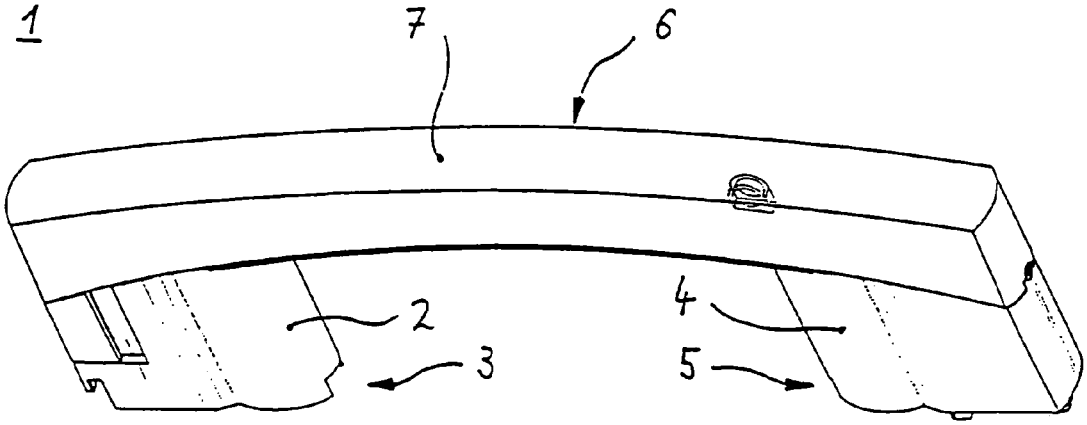
FIG. 1 is an overall perspective view of a double pressure cylinder arrangement.

A double pressure cylinder arrangement according to FIG. 1 has an essentially u-shaped housing element 1, a first leg section 2 of which forms a cylinder housing for a pressure cylinder 3, while a second, opposing leg section 4 forms a cylinder housing of a further pressure cylinder 5. A carrier strut 6 is also provided linking the first pressure cylinder 3 with the second pressure cylinder 5 on their cylinder bottom sides. This results in an arrangement of the two pressure cylinders 3 and 5 in an axis-parallel and spaced relationship. Carrier strut 6 is formed by a hollow intermediate section 7 of the common u-shaped housing element 1.

Figure 2:
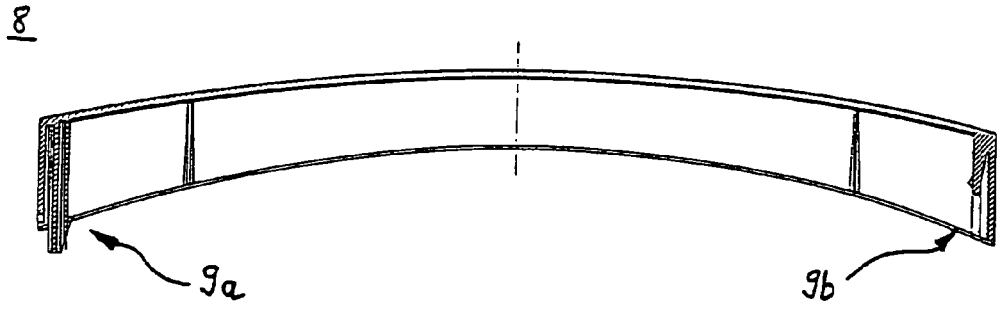
FIG. 2 is a longitudinal sectional view of a cover thereof.

According to FIG. 2, u-shaped housing element 1 is closed by a cover 8, shown on its own, which fits on the intermediate section 7 of u-shaped housing element 1. The attachment of u-shaped housing element 1 is achieved by positive engagement means 9*a* and 9*b*, the latter shown as a clip connection provided on opposite ends of cover 8 (see also FIG. 4). Both cover 8 and the remaining u-shaped housing element 1 are of plastic material and manufactured using an injection molding process.

Figure 3:
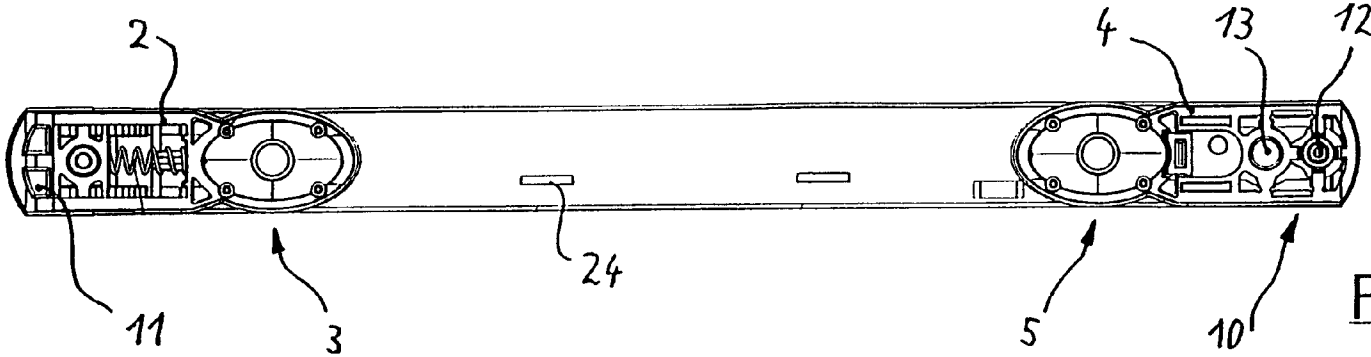
FIG. 3 is a bottom view of the double pressure cylinder arrangement according to FIG. 1.

According to FIG. 3, connection means 10 for common fluid and electrical supply of the two pressure cylinders 3 and 5 exit in the area of the bottom surface of pressure cylinder 5. On the side of the other pressure cylinder 3, means 11 for releasably locking a carrier construction (not shown) (such as a loading device of a drafting arrangement) is arranged to an outside the first leg section of the double pressure cylinder arrangement adjacent to the pressure cylinder. The connection means 10 comprise a fluid connection 12 for pressure medium lines for applying a pressure to the two pressure cylinders 3 and 5 and next to it an electrical connection 13 for electrical lines for position sensors (not shown). The connection means 10 are integrated adjacent to pressure cylinder 5 in leg section 4 of common housing element 1. Means 11 for releasably locking, on the other hand, are integrated in leg section 2 of common housing element 1 adjacent to pressure cylinder 3.

Figure 4:
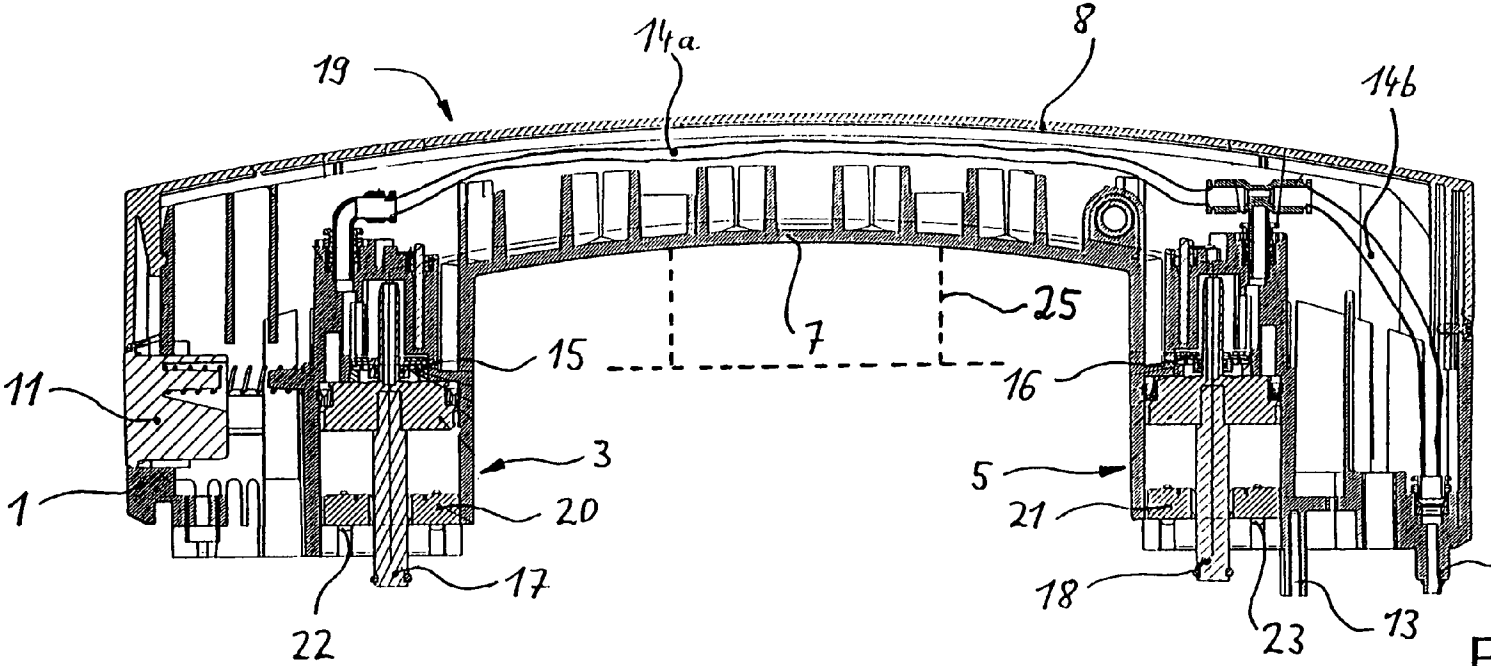
FIG. 4 is a longitudinal sectional view of the double pressure cylinder arrangement according to FIG. 1.

According to FIG. 4, the material reinforced intermediate section 7 contains pressure medium lines 14*a* and 14*b* for passing pressurized air from fluid connection 12 to pressure cylinder 5 and further to pressure cylinder 3, in order to synchronously apply a pressure to the two pressure cylinders 3 and 5 at the bottom of the cylinders. Electrical lines (not shown) extend from electrical connection 13 to position sensors 15 and 16 integrated with the pressure cylinders 3 and 5 for detecting the position of the associated piston rods 17 and 18, respectively. The connection lines are accessible in the area of intermediate section 7 via cover 8, extending along the top 19 of intermediate section 7 and attached to housing element 1 via clip attachments secured by bolts. Pressure cylinders 3 and 5 are also closed by cylinder covers 20 and 21, through which piston rods 17 and 18, respectively, extend to provide protection against ambient dirt. The two cylinder covers 20 and 21 are held in place by at least one bolt 22 and 23, respectively, inserted in the gap between cylinder covers 20 and 21, respectively, and housing element 1.

The double pressure cylinder arrangement described above as a preferred exemplary embodiment is preferably part of a loading device for a drafting arrangement of a textile machine as described in EP 0 939 151 A2 and is for loading individual top rollers for extending fiber material.

In the case of this preferred application, intermediate section 7 of double pressure cylinder arrangement may advantageously serve for clip fastening a vacuum sheet 25 of the drafting arrangement for sucking up free fibers, wherein such vacuum sheet 25 can be attached on intermediate section 7 by means of recesses 24.

The double pressure cylinder arrangement of the present invention is not limited to this preferred application, but may also be used with other suitable applications.

The invention has been described in detail with respect to exemplary embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A double pressure cylinder arrangement, comprising:

a substantially u-shaped housing element comprising two leg sections connected by a carrier strut having an intermediate section;

a first pressure cylinder housed in one of the two leg sections;

a second pressure cylinder housed in the other of the two leg sections and positioned in a spaced and axis-parallel relationship to the first pressure cylinder; and connection lines for driving the first pressure cylinder and the second pressure cylinder integrated in the intermediate section.

2. The double pressure cylinder arrangement according to claim 1, wherein the intermediate section is hollow.

3. The double pressure cylinder arrangement according to claim 1, wherein the leg sections are cylindrical.

4. The double pressure cylinder arrangement according to claim 1, further comprising:

a releasable lock operative to releasably lock a carrier construction on the arrangement, the releasable lock being integrated into one of the leg sections of the housing element next to said pressure cylinder.

5. The double pressure cylinder arrangement according to claim 1, further comprising:

at least one of a fluid connection and an electrical connection operative to supply at least one of fluid and electrical power to the first pressure cylinder and the second pressure cylinder.

6. The double pressure cylinder arrangement according to claim 5, wherein at least one of a fluid connection and an electrical connection is integrated at least in the area of one of the leg sections of the housing element next to the pressure cylinder in the leg section.

7. The double pressure cylinder arrangement according to claim 6, wherein the at least one of a fluid connection and an electrical connection exit on the bottom surface of the one of the leg sections of the housing element, where pressure medium lines or electrical lines may be connected to them.

8. The double pressure cylinder arrangement according to claim 5, wherein the releasable lock on one hand and the at least one of a fluid connection and electrical connection on another hand are each exclusively associated with one of the leg sections of the housing element.

9. The double pressure cylinder arrangement according to claim 8, wherein the at least one of a fluid connection and an electrical connection is accommodated in an area situated to an outside of the one leg section adjacent to one of the first pressure cylinder and the second pressure cylinder.

10. The double pressure cylinder arrangement according to claim 8, wherein the releasable lock is arranged to an outside of the first leg section adjacent to the pressure cylinder.

11. The double pressure cylinder arrangement according to claim 1, wherein the connection lines comprise pressure medium lines for driving the first pressure cylinder and the second pressure cylinder and electrical signal lines for position sensors associated with the first pressure cylinder and the second pressure cylinder.

12. The double pressure cylinder arrangement according to claim 1, further comprising:

a cover extending along a top of the intermediate section and being releas ably attached on the housing element with a clip connection, the cover being operative to permit access to the connection lines.

13. The double pressure cylinder arrangement according to claim 12, wherein at least the housing element and the cover are plastic material.

14. The double pressure cylinder arrangement according to claim 1, wherein the first pressure cylinder and the second pressure cylinder are single-acting type.

15. The double pressure cylinder arrangement according to claim 1, further comprising:

a piston rod for each of the first pressure cylinder and the second pressure cylinder, wherein the first pressure cylinder and the second pressure cylinder utilize pressurized air as a pressure medium to simultaneously extend the piston rods.

16. The double pressure cylinder arrangement according to claim 15, further comprising:

a cylinder cover covering each of the first pressure cylinder and the second pressure cylinder, wherein each piston rod extends through one of the cylinder covers; and a bolt operative to hold each cylinder cover in place, the bolt engaging a gap between the cylinder cover and the housing element.

17. A loading device for a drafting arrangement of a textile machine, the loading device comprising:

a double pressure cylinder arrangement according to claim 1 for loading individual top rollers for extending fiber material.

18. The loading device according to claim 17, further comprising a plurality of recesses on the intermediate section of the double pressure cylinder arrangement, the recesses being adapted for clip-fastening a vacuum sheet of the drafting arrangement.

19. The double pressure cylinder arrangement of claim 1, wherein one of the two leg sections is integral with a housing for the first pressure cylinder and the other of the two leg sections is integral with a housing for the second pressure cylinder.

* * * * *